United States Patent [19]

Inman

[11] 4,185,569

[45] Jan. 29, 1980

[54] METHOD AND APPARATUS FOR TUFTING EVEN LEVEL CUT PILE AND LOOP PILE IN THE SAME ROW OF STITCHING

[75] Inventor: Billy E. Inman, Chattanooga, Tenn.

[73] Assignee: Spencer Wright Industries, Inc., Chattanooga, Tenn.

[21] Appl. No.: 7,386

[22] Filed: Jan. 29, 1979

[51] Int. Cl.[2] ..... D05C 15/00

[52] U.S. Cl. ..... 112/79 R

[58] Field of Search ..... 112/79 R, 79 A, 79 FF

[56] References Cited

U.S. PATENT DOCUMENTS

| | | | |
|---|---|---|---|
| 3,084,645 | 4/1963 | Card | 112/79 R |
| 4,134,347 | 1/1979 | Jolley et al. | 112/79 R |

*Primary Examiner*—Ronald Feldbaum

*Attorney, Agent, or Firm*—Alan Ruderman

[57] ABSTRACT

A tufting machine has loop seizing hooks facing opposite to the direction of fabric feed and gate members mounted for closing the bill of the hooks to prevent the hook from seizing selective loops and for themselves seizing those loops. In one embodiment the gate members are pivotably mounted on the hooks. In another embodiment the gate members are slidable mounted adjacent to and rock with the hooks. Loops precluded from seizure by the hooks are shed by the gate as the hooks rock away from the loop seizing position and form uncut loop pile. Loops that are allowed to be seized by the hooks enter onto the blade portion of the hooks and are cut by a knife cooperating with each hook blade to form cut pile. The gate members are disclosed as moved by pnuematic cylinders operable by electrically controlled air valves. The air valves selectively respond to timed signals received from a pattern control.

22 Claims, 11 Drawing Figures

METHOD AND APPARATUS FOR TUFTING EVEN LEVEL CUT PILE AND LOOP PILE IN THE SAME ROW OF STITCHING

BACKGROUND OF THE INVENTION

This invention relates to tufting machines and more particularly to a method and apparatus for selectively forming cut pile and loop pile having substantially the same pile height as the cut pile in the same row of stitching in a backing fabric.

In U.S. Pat. of R. T. Card, No. 3,084,645, a method and apparatus for tufting cut pile and loop pile in the same row of stitching is disclosed. In spite of the enormous commercial success of that method and apparatus, and of the tufted product produced thereby, it has an inherent shortcoming that has limited it from even further success and acceptance of the tufted product produced. Because uncut loop pile is formed by backrobbing yarn from that loop to move a spring clip away from the point of the hook to allow the loop to be withdrawn from the hook while cut pile is not formed by backrobbing, it produces a tufted product having cut pile ends that project from the backing fabric more than the uncut loop pile. Thus, the pile height of the fabric produced is not level, but varies with the pattern. The cut pile has a greater pile height than the shorter uncut pile which appears less dense. This effect distracts from the appearance of the tufted product and has limited its appeal.

As pointed out in the aforesaid U.S. Pat. No. 3,084,645 there have been other, but commercially unsatisfactory, approaches for patterning a fabric selectively with cut pile and loop pile. In U.S. Pat. of McCutchen No. 2,879,728 selective loops on the hook are pushed off by a pattern controlled finger while others are allowed to stay on and are cut. Another proposal is illustrated in U.S. Pat. of McCutchen No. 2,879,729 wherein each needle has two opposed hooks associated therewith, one with a knife. When cut pile is desired a loop is transfered from the hook without the knife to the one with the knife. Although these proposals illustrate even level cut and loop pile their shortcomings are readily apparent; simplicity and reliability being primary concerns of the tufted fabric industry.

An effective approach to obtaining even level cut and loop pile is disclosed in U.S. Pat. No. 4,134,347 of Jolley et. al., assigned to the common assignee of the present invention, in which a pivotable gate member engagably cooperates with the bill of the hook to selectively open or close the passage from the bill to the hook blade of a seized loop. The loop is seized by the bill and the gate either allows or prevents a loop from moving beyond the bill to the closed end of the hook. Those loops that are allowed passage are cut, the other loops are shed by the bill. Setting of the stitches in the fabric draws both the cut and uncut loops to substantially the same level.

SUMMARY OF THE INVENTION

The present invention provides an effective mechanism and method for forming tufted fabrics having a patterned array of cut pile and loop pile in any row of stitching by preventing selective loops from being seized by the hook. A needle loop is selectively seized by either a cut pile hook or a gate member beneath the bill of the hook. The gate is movable between an open position which allows the hook to seize the loop, and a closed position wherein the hook is closed and the loop is seized on the gate. Those loops seized by the hook move along the blade of the hook toward the closed end where they in turn are cut by a knife as in conventional cut pile machines. However, those loops seized by the gate when the gate is closed are prevented from seizure by the hook. In effect, the closed gate is itself a hook and the loops seized thereby are shed or released by the gate to form loop pile as the gate and hook move from their loop seizing positions. A conventional pattern control may be employed for controlling the operation of the gate. No additional backrobbing beyond that conventionally done to set the stitches into the backing is required so that the pile height of the cut and uncut patterned pile is substantially level, and conventional feed rolls rather than a yarn feed pattern attachment may be used.

In one preferred form of the invention the gate is pivotably mounted relatively to the hook and preferably on the hook while in another preferred form the gate is slidably mounted relatively to the hook and preferably in the hook support bar so as to move with the hook as the hook conventionally moves toward and away from the loop seizing position. The gate, in the first embodiment, is moved about its pivot journal, and in the second embodiment, is slideably reciprocated forwardly and backwardly in its support channel, as determined by the pattern control, selectively to present either the hook or a portion of the gate as the loop seizing element. When the loop is tightened to set the stitch, the loop is drawn to the level of the loop engaging edge of the blade of the hook. Those loops on the hook are cut. There is no additional back-drawing of yarn so that both the cut pile and the uncut loop pile are at substantially the same level. Because the gate member itself functions as a hook for loop pile, the timing of its movement should be less critical than that in the aforesaid patent of Jolley et. al with less of a possibility of spearing a loop when operating at off design speeds with the heavier yarns.

Consequently, it is a primary object of the present invention to provide an improved method and apparatus for forming tufted fabrics having in each row of stitching a patterned array of cut pile and loop pile which can be of substantially the same pile height.

It is another object of this invention to provide in a tufting machine a hook adapted to point in the direction opposite the fabric feed and a gate member associated with and mounted for movement relatively to the hook to selectively close the bill of the hook to prevent the hook from seizing a loop of yarn and which gate member itself may then seize the loop.

It is a further object of the present invention to provide in a tufting machine a movable gate member for a cut pile hook positioned in accordance with a pattern control for selectively precluding loops from being seized by the hook and itself seizing such loops while allowing other loops to be seized by the hook.

It is still a further object of the present invention to provide in a tufting machine a movable gate member for a cut pile hook positioned in accordance with a pattern control selectively for seizing a loop of yarn and closing the hook to that loop to produce loop pile and selectively for opening the hook to allow seizure of a loop by the hook so that yarns seized by the hook may be cut to produce cut pile.

It is yet a further object of the present invention to provide a method for tufting cut pile and loop pile in the same row of stitching wherein the loops to be cut are seized by a conventional cut pile hook and the loops that are to remain uncut are seized by a controlled gate member movable relatively to the hook.

It is still yet another object of the present invention to provide a gate member associated with a tufting machine cut loop hook which gate member has a closing portion for closing the bill of the hook from seizing a loop and a loop seizing portion for seizing a loop when the hook bill is closed.

BRIEF DESCRIPTION OF THE DRAWINGS

The particular features and advantages of the invention as well as other objects will become apparent from the following description taken in connection with the accomanying drawings, in which.

DESCRIPTION OF THE PREFRRED EMBODIMENTS

Figure 1:
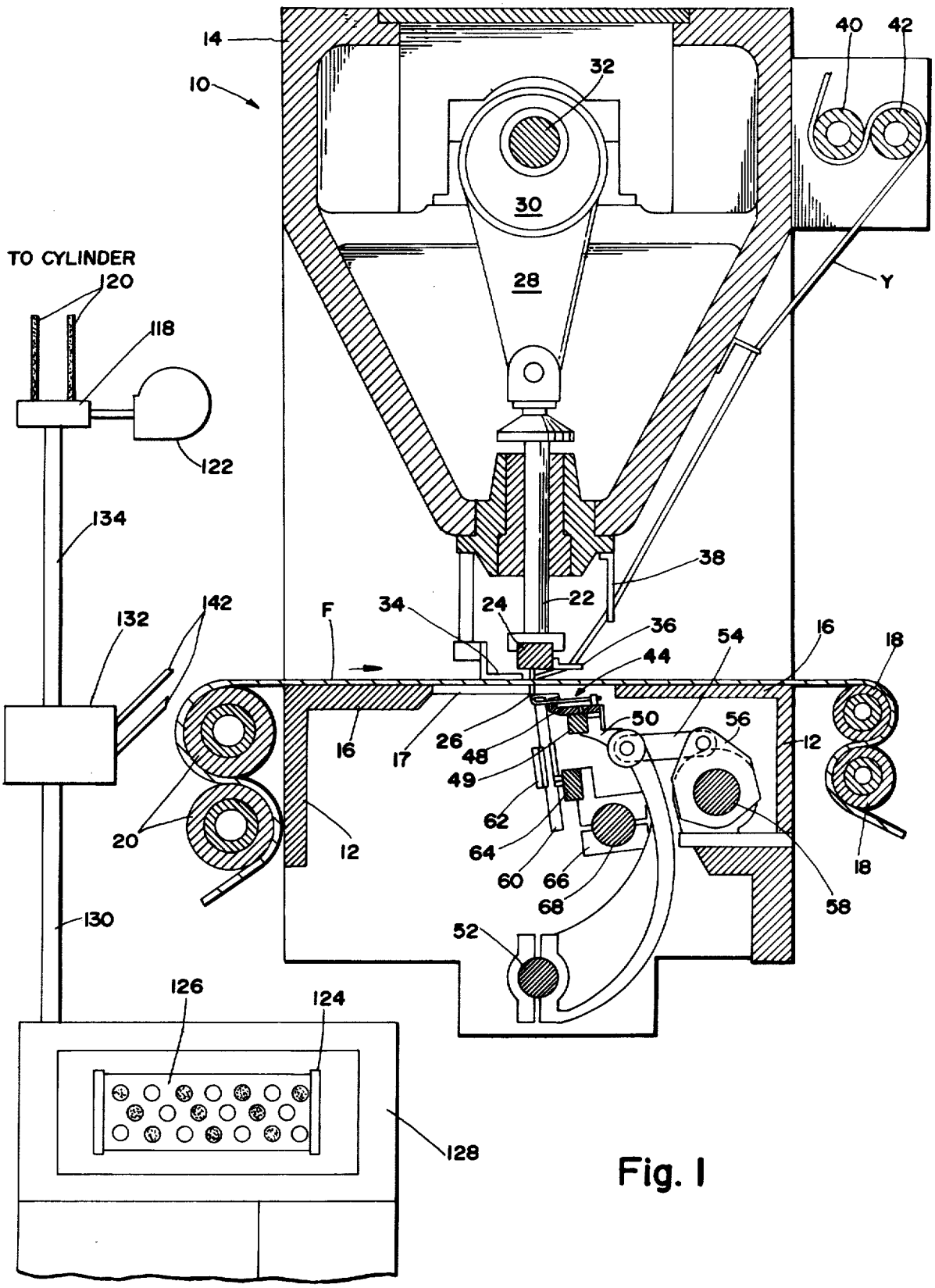
FIG. 1 is a vertical sectional view taken transversely through a multiple needle tufting machine having a first embodiment of apparatus constructed in accordance with the principles of the present invention, and illustrating certain features in diagrammatic form.

Referring now to the drawings, FIG. 1 illustrates a first embodiment of the invention incorporated in a tufting machine 10 having a frame comprising a bed 12 and a head 14 disposed above the bed. The bed 12 includes a bed plate 16 having a support fingerplate 17 across which a fabric F is adapted to be fed in the direction illustrated by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F through fingers on the support plate 17 upon reciprocation of the needle bar 24 to project loops of yarn Y therethrough. Endwise reciprocation is imparted to the push rods 22 and thus the needle bar 24 and needles 26 by a link 28 which is pivotably connected at its lower end to the push rods 22 and at its upper end to an eccentric 30 on a driven rotary main shaft 32 that is journalled longitudinally in the head 14. A presser foot assembly 34 may be supported on the head 14 to hold down the fabric F during needle retraction. A yarn-jerker 36 is carried by the needle bar 24 and operates to engage the yarn between a stationary yarn guide 38 on the frame of the machine and the needles 26.

Yarn Y is supplied to each needle 26 by any convenient type of yarn feed mechanism which, unlike that required in the aforesaid U.S. Pat. No. 3,084,645, need not be controlled to feed selectively. Thus, conventional yarn feed rolls 40 and 42 adapted to be continuously rotated by any convenient means, preferably synchronized with the main shaft 32, to continuously feed fixed lengths of yarn to the needles may be mounted on the head 14. For reasons which should be apparent the amount of yarn fed to the needles is less than that demanded by the system so that yarn is pulled back from each loop after it has been formed as each stitch is tightened and set into the fabric F.

Mounted within the bed for cooperation with the needles to seize loops of yarn presented thereto are a plurality of loopers generally indicated at 44 comprising hooks 43 and gates 45 best illustrated in FIG. 2 and as hereinafter described. The hooks, to which further reference will be made, are of the cut pile type which point in the direction opposite to that which the fabric is fed. The hooks have mounting portions 46 that are mounted in hook bars 48 carried by a mounting bar 49 secured to the upper end of a rocker arm 50. Any conventional means to oscillate the arm 50 may be provided. It is preferred that the lower end of the rocker arm 50 is clamped to a laterally extending rock shaft 52 journalled in the bed. Pivotably connected to the upper portion of the rocker 50 is one end of a connecting link 54 having its other end pivotably connected between forked arms of a jack shaft rocker arm 56. The arm 56 is clamped to a jack shaft 58 which has oscillating motion imparted thereto by conventional drive means such as a cam and lever means (not shown) from the main shaft 32 in timed relationship with the reciprocation of the needles.

The tufting machine incoporates a plurality of knives 60 which may cooperate with the hooks to cut the selected loops thereon to form cut pile as hereinafter described. The knives may be mounted in knife blocks 62 secured to a knife bar 64 which in turn is secured to a knife shaft rocker arm 66 clamped to a knife shaft 68. Oscillatory movement is imparted to the knife shaft 68 to conventionally drive the knives into engagement with one side of the respective hooks as known in the art to provide a scissors like cutting action.

Figure 2:
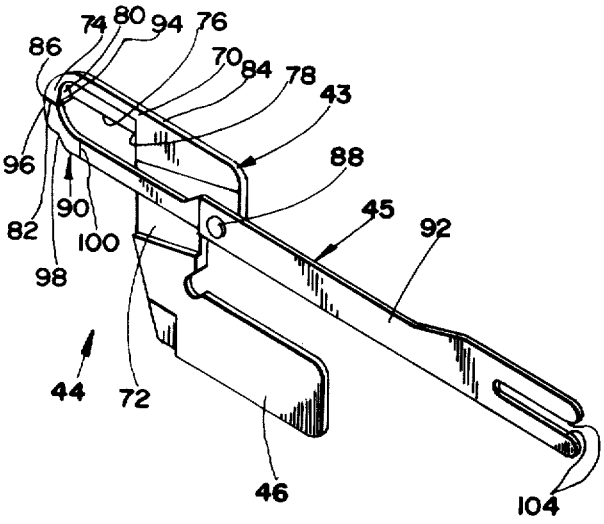
FIG. 2 is a perspective view of the hook and gate in the first embodiment of FIG. 1.

In accordance with the invention the hooks 43, as best illustrated in FIG. 2, are planar members having a body portion including a blade 70 and a shank 72 which includes the mounting portion 46, and a bill 74 at the free end extending from the blade. The blade 70 extends from the shank 72 and has a bottom edge 76 extending from a throat 78, formed between the blade and the shank, and an edge 80 joining the bottom edge 76 of the blade with a bottom edge 82 of the bill. The blade has a top edge 84 that may merge down the bill to meet the bottom edge 82 to form a point 86. As illustrated, the bottom edge 82 of the bill is spaced below the bottom edge 76 of the blade, the latter being substantially the level to which all the loops are pulled. Cutting of a loop on the blade by the knife 60 ideally occurs at the edge 76 adjacent to the throat 78.

A bushing (not illustrated) may be mounted in a hole (not shown) in the gate member 45 so that together they are pivotably journalled on a screw 88 that is threaded into the shank 72 at the side of the hook opposite to that against which the knife 60 acts. The gate 45 includes a head portion 90 at one extremity facing in the same direction as the hook bill and a tail portion 92 at the other side of the pivot screw 88. The gate thus acts as a pivotable lever. The head 90 includes a substantially upper free edge 94 defining a latch adapted to engage the bottom edge 82 at the point 86 to close the bill from seizing a loop by preventing selected loops from entering onto the hook when the gate is closed. Preferably the edge 94 is a flat surface substantially at least the same size as the bottom edge 82 of the bill 74 to ensure closure of the bill, but need only be of sufficient size to close the point 86. The head portion 90 also includes a smoothly formed leading edge 96 and preferably has a small smooth preferably concave indentation 98 below the edge 96 so the gate may selectively seize and then release or shed a loop as hereinafter described. Since the gate is mounted on one side of the hook it is bent slightly at 100 from the plane of the face or surface of the hook at the shank to substantially intermediate the faces at the bill so the surfaces 94 and 82 may properly engage. Thus, when the gate is closed no loop will slip by the head 90 onto the bill.

To pivotably move the gate about its pivot journal the tail portion 92 of the gate may be selectively actuated by any convenient means controlled by a pattern. In the preferred embodiment each tail 92 is received between a forked member 102 which entraps a slot 104 in the tails about a pin 105 extending between the tines of the member 102 for swinging movement. The forked members 102 are secured to stems 106 of pistons (not illustrated) of respective pneumatic cylinders 108 mounted in supporting bars 110 that may be mounted for oscillation with the hooks 43. To this end the supporting bars 110 may be secured to a bracket 112 that is attached by bolts 114 or the like to the rocker arm 50 and the supporting bars 110 may rest on or be secured to the upper surface of the mounting bar 49 adjacent to the hook bar 48. As illustrated, the pistons of the cylinders 108 are normally biased downwardly so that normally the gates are positioned to close the bills for forming loop pile, but the reverse situation with upwardly biased pistons may be constructed readily. Thus, as illustrated, to form cut pile, air is admitted to inlet nipples 116 to drive the pistons and forked members 102 upwardly to pivotably open the gates. The admission and release of air from each of the cylinders 108 is effected by respective electrically controlled pneumatic valves 118 having air lines 120 communicating the valves with a compressor 122 or other source of air under pressure. The pneumatic system is preferred because of their large stroke for their size but other means such as electrical solenoids or a mechanical drive may be used in place of the cylinders, valves and compressor. The valves are, however, electrically controlled to allow pressurized air from the compressor to enter the cylinders or to vent the air from the cylinders to atmosphere, thereby pivoting the gate.

To control the valves 118 and thereby the pile type produced by a given needle loop any convenient patterning device may be used, such as a magnetic tape system, a punched tape system or a microprocessor with programmed memory. However, as is conventional in the tufting industry it is preferred to use a transparent pattern drum 124 carrying a pattern sheet 126 having a pattern painted with opaque material on a transparent sheet mounted in a console 128. Since this pattern reading and signaling mechanism is well known in the art reference may be had to Ingham et al U.S. Pat. No. 3,922,970 or Erwin et al U.S. Pat. No. 3,272,163 for a more complete description thereof. Suffice it to say that photocells within the console sense the light and dark areas of the pattern through the drum by mounting a source of light on one side of the drum and the photocells on the other side. The output of the photocells are transmitted to switching units within the console 128, the outputs of which are transmitted by wires within a conduit 130 to an amplifier 132 where these signals are amplified and transmitted by wires within conduits 134 to the individual pneumatic valves 118.

Figure 6:
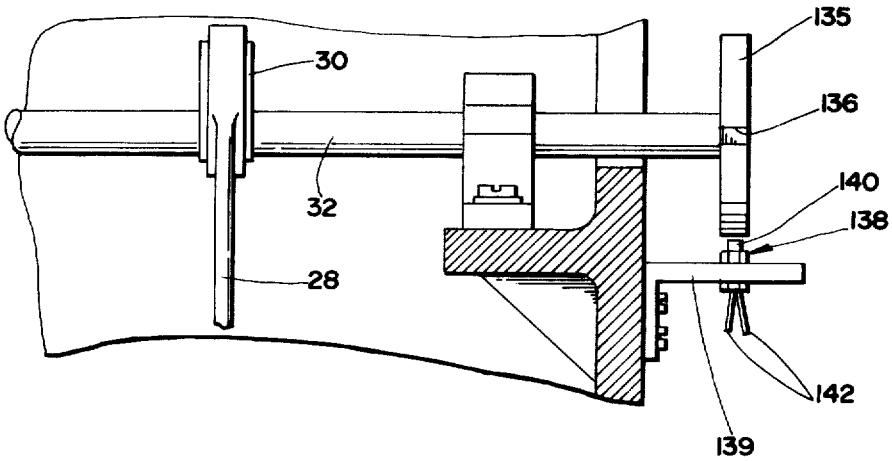
FIG. 6 is a fragmentary front elevational view partly in section of the tufting machine illustrating a method of synchronizing the actuation of the gates to the rocking movement of the hooks.

Although spearing of a previous loop appears to be less probable with this invention than that of the aforesaid U.S. Pat. No. 4,134,347, it is still desirable to ensure that the signals from the pattern console 128 are timely presented to the valves 118 so that the pneumatic cylinders actuate the gates when a loop is either off the head of the gate for uncut pile or behind the edge 80 and onto the blade for loops to be cut. Thus, synchronizing means timed to the oscillation of the hooks may be provided. This can be any convenient means, but a simple one that is preferred, like in U.S. Pat. No. 4,134,347, is a clocking circuit providing a pulse timed to the exact position of the tufting machine main shaft 32 to enable and disable the signals received by the amplifier 132 from the pattern console 128. To this end, as illustrated in FIG. 6, a metallic timing disk 135 may be fixed on the main shaft 32 adjacent to one end; the disk having a slotted truncated radial opening 136 of a small peripheral arc. A proximity probe 138 may be threadedly mounted on a bracket 139 on the head 14 and includes a sensing head 140 extending toward and just spaced from the circumference of the disk 136. The probe, which is basically a metal detector, includes conducting leads 142 which are connected to the amplifier 132 into circuitry which may include proximity switching means (not illustrated) in the circuit with the amplified outputs of the photocells. Synchronizing systems of this type and the circuitry therefor are well known and further description thereof is not deemed necessary to the present invention. Whenever the solid circumference of the disk is adjacent to the probe head 140 the primary output of the sensor goes high and when the slot passes the head 140 the primary output is switched low. A pulse timed to the rotation of the main shaft 32 and therefore the oscillation of the hooks 44 is provided to energize the amplifier circuits for transmitting timed photocell signals to the valves 118.

Figure 3:
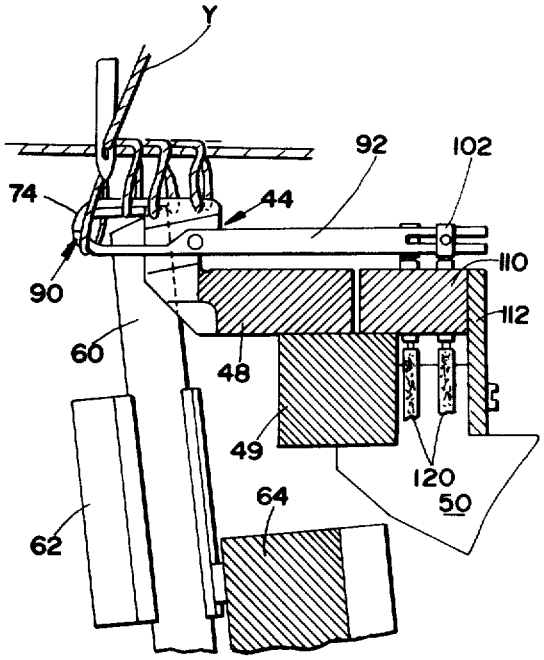
FIG. 3 is a fragmentary vertical sectional view of a portion of the tufting machine illustrated in FIG. 1, but enlarged to show the hook with the gate closed to form uncut pile with these elements rocked to a forward position and just subsequent to loop seizure by the gate.
Figure 4:
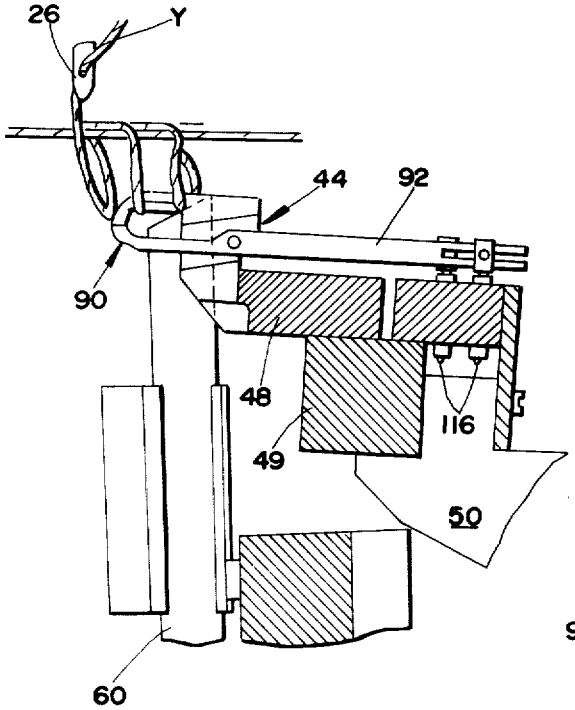
FIG. 4 is a view similar to FIG. 3, but showing the hook slightly later in a rearward position as it is rocked away from the needle and illustrating the loop being shed from the gate.

In operation, a loop represented by a needle will either be seized by the hook 43 or by the head 90 of the gate 45. Since the bill 74 faces oppositely to the direction of fabric feed the loop is moved by the fabric in a direction toward the closed end of the hook as the hook oscillates away from the loop seizing position. Now if the pattern on the sheet 126 has called for this needle stitch to be an uncut loop, a signal to this effect was timely given after the previous stitch to move the corresponding valve 118 to vent air from the cylinder 108. Thus, since the pistons are normally biased downwardly the gates are pivoted so that the upper edge surface 94 engages the bottom edge 82 of the bill 74 to close the hook against seizing a loop and the head 90 of the gate itself seizes the loop as illustrated in FIG. 3. As illustrated in FIG. 4, this loop prevented from moving onto the hook is shed by the gate as the gate oscillates away from the loop seizing position with the hook. As previously stated the amount of yarn fed the system conventionally is set less than that required so that as the needle bar reciprocates upwardly the yarn jerker 36 draws back the loop. This together with possible further backdrawing, if desired, by the needle on the next down stroke draws the loop to the level of the edge 76 of the hook blade so that an uncut loop at that level is formed.

Figure 5:
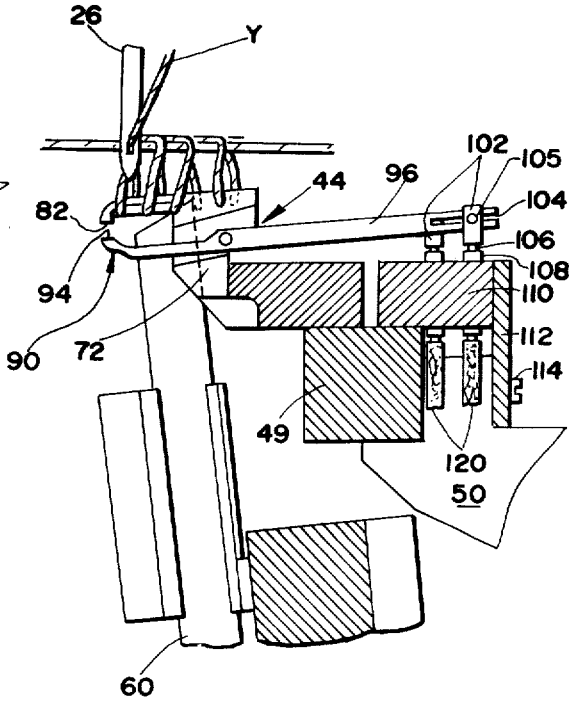
FIG. 5 is a view similar to FIG. 3, but showing the hook with the gate open to allow a loop to be seized by the hook so the loop can move rearwardly to the closed end of the hook where it is severed by a knife to form a cut pile.
Figure 7:
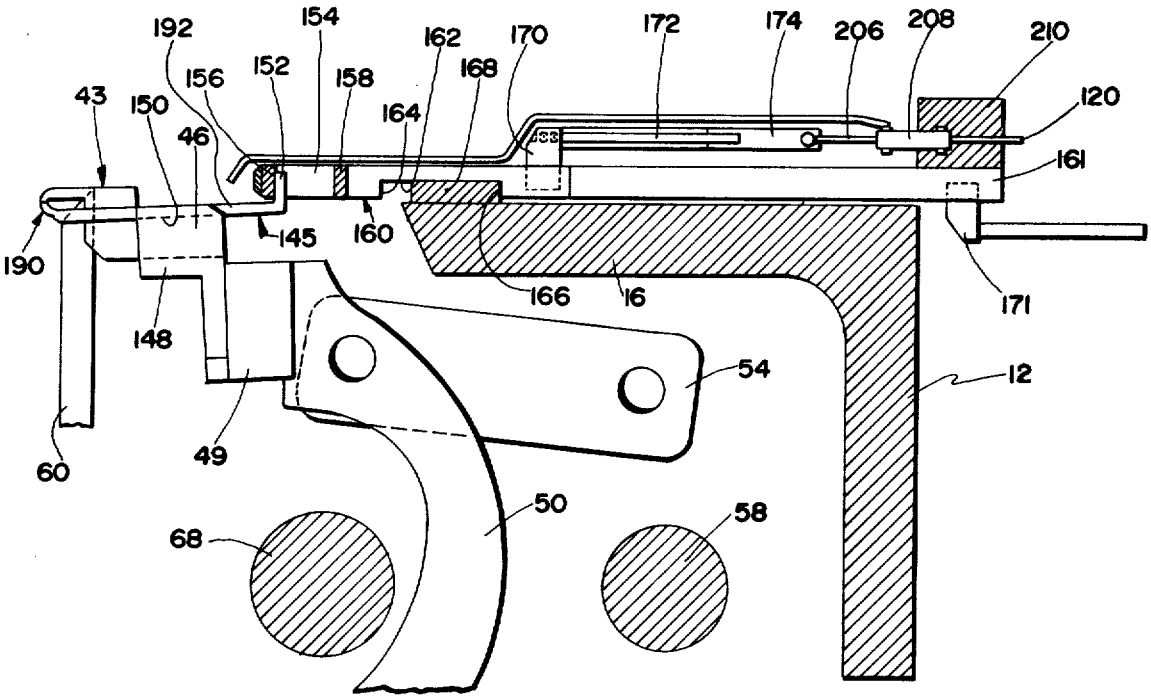
FIG. 7 is a vertical sectional view taken through a multiple needle tufting machine similar to FIG. 1, but with certain of the elements deleted for clarity, and illustrating a second embodiment of apparatus constructed in accordance with the principles of the present invention.

If the pattern next calls for a cut pile the signal is clocked to the respective valve 118 which admits pressurized air to the cylinder after the previous loop has been shed and the gate is pivoted to move the surface 94 away from the bill 74. Thus, as illustrated in FIG. 5, the loop is now seized by the hook and, being prevented from shedding by the edge 80 of the bill, moves from the bill to the blade as the fabric moves the loop toward the shank end of the hook. Now as the loop is backdrawn, it is drawn up against the edge 76 of the blade and gradually moves rearwardly to the knife cutting location where it is severed by the knife 60 to form cut pile at the same level as the uncut loops.

The pattern will determine the number of successive loops that will be cut or uncut. To prevent the gate from pivotably oscillating unnecessarily the gate should stay open on successive cut pile stitches and closed on successive uncut loops and should only be actuated when a positive switching signal is given to the valves. It should be understood that though the disclosure only related to one hook, a tufting machine has a multiplicity of hooks and that by incorporating the gating feature of the present invention in many, and preferably all, of the hooks, unique patterning effects may be produced in the base fabric.

In the second disclosed embodiment, to wit, that illustrated in FIGS. 7-11, the hook and most of the other elements, with the exception of the gate and its actuating means, may be identical to those of the embodiment of FIGS. 1-6. In this form of the invention each gate 145, which has a head 190 similar to the head 90 of the first embodiment, is slideably mounted in a respective slideaway or channel 150 which may be formed in the hook bar 148 adjacent to the mounting portions 46 of the hooks 43. The gates 145 each have a tail portion 192 terminating at an upstanding tang 152. Each tang 152 is received within an opening 154 formed between two wall portions 156 and 158 in a slide block 160. Each block 160 is an elongated member extending in the direction transversely of the tufting machine, and the distance between the walls 156 and 158 is substantially equal to the throw or movement of the hook 43 as it is rocked to and fro.

On the underside of the slide block 160 behind the opening 154 there is a recessed or cut-out portion 162 having a pair of opposed surfaces 164 and 166 defining the limits of the recess 162 in the direction transverse to the tufting machine. The recessed portion 162 is positioned on a stop block 168 secured to the bed plate 16 and can slide thereon. The size of the stop block relative to the recessed portion determines the distance which the block 160 can slide. At the end of the block 160, remote from the hook 43 and the recess 154, a connecting member 170 may be secured. The member 170 is illustrated as upstanding since from a space standpoint an adjacent hook may be positioned with similar mechanism, but with a longer slide block 161 having a downward member 171. A rod 172 is conventionally secured at one end to the member 170, preferably with threads for adjustment purposes, and the rod may be secured at its other end to one end of another connecting member 174 which in turn is connected at its other end to the piston rods 206 of respective pneumatic cylinders 208 mounted in support bars 210.

Figure 10:
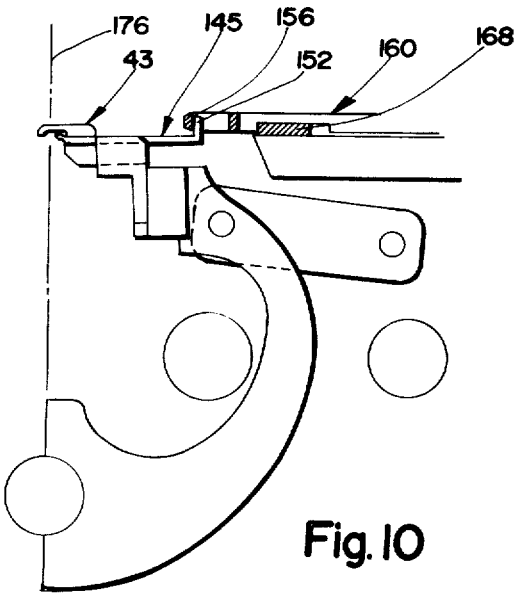
FIG. 10 is a view similar to FIG. 8, but with the hook forward for loop seizure and the gate open in the cut pile position.
Figure 11:
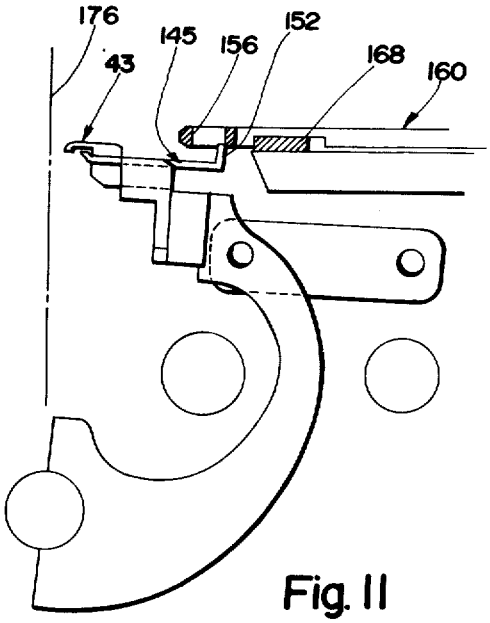
FIG. 11 is a view similar to FIG. 9 but with the gate open and the hook rearwardly in the loop shedding position.

Thus, it can be seen that actuation of the cylinders 208 controls the gates 145 in a manner similar to that of the first embodiment, but the gates slide rather than pivot to open and close the hooks. Consequently, the gates in this embodiment can be considered to be slidable shuttles. The cylinders 208 may be identical to the cylinders 108 and be normally biased with the rods 206 into the cylinders. This would normally keep the slide block 160 in the rearward position with the surface 164 engaged against the stop block 168, which is the cut loop position illustrated in FIGS. 10 and 11. Thus, if the pattern on the sheet 126 has called for a cut pile, a signal to this effect is timely given to the valve 118 to vent air from the cylinder 108 and the slide 160 is positioned rearwardly. When the looper rocks forwardly toward the loop seizing position the tang 152 of the gate 145 engages the wall 156 of the opening 154, as shown in FIG. 10, and is prevented from following the hook. This opens the hook for seizure of the loop. As in the first embodiment, the loop seized by the hook remains thereon when the hook rocks back away from the needle center line 176 as in FIG. 11, and moves toward the closed end where it is cut.

Figure 8:
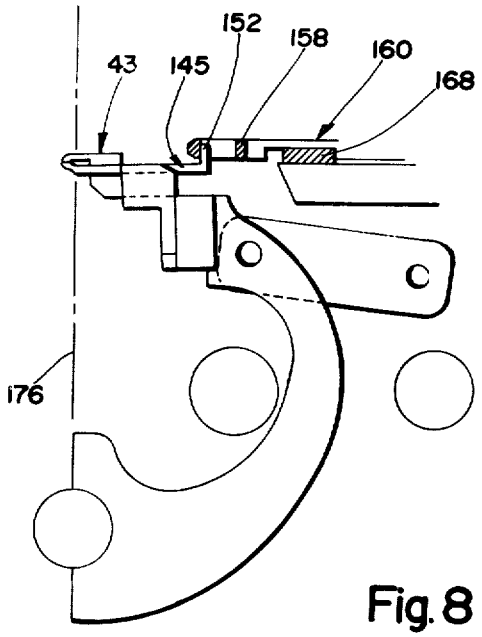
FIG. 8 is a fragmentary vertical sectional view partly diagrammatic of a portion of the tufting machine illustrated in FIG. 7 showing the hook and gate of the second embodiment with the gate closed and the hook rocked forwardly for loop seizure by the gate, and which for clarity of illustration does not show the knife.
Figure 9:
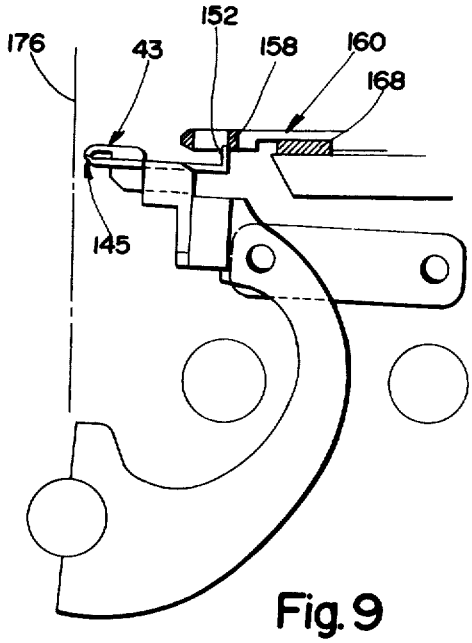
FIG. 9 is a view similar to FIG. 8, but with the hook rearwardly in the loop shedding position.

When the pattern calls for an uncut loop the signal is clocked to the respective valve 118 to admit pressurized air to the cylinder 208. This forces the slide member 160 forwardly to engage the surface 166 against the stop block 168 as illustrated in FIGS. 8 and 9. When the looper is now in the rearward position shown in FIG. 9, the tang 152 engages the wall 158 and positions the gate 145 forwardly with respect to the hook 43 to close the hook. When the hook rocks forwardly the gate seizes the next loop as in the first embodiment and then sheds it as the hook rocks away from the needle center line 176.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. In a tufting machine, means for feeding a base fabric in one direction, a yarn-carrying needle for penetrating the base fabric and forming loops therein, means for feeding yarn to said needle, a hook disposed on the opposite side of the base fabric from said needle, said hook comprising a body portion including a blade and a loop seizing bill extending from said blade facing in a direction opposite to the direction of fabric feed, means for mounting said body portion for oscillatory movement toward and away from said needle so that said hook enters successive loops, the feeding of the fabric moving the loops toward the body portion, a knife cooperating with said blade for severing loops thereon, gate means oscillating with the hook for selectively engagably cooperating with said hook for closing the bill to prevent the loops from being seized by the hook and for seizing the loops, and for disengaging said hook and not entering the loops to open the bill and permit loops to be seized by the hook, whereby loops seized by the hook are severed by said knife and loops seized in the gate are shed, and control means for selectively moving said gate means into and out of engagable cooperation with said hook.

2. In a tufting machine as recited in claim 1 wherein said gate means comprises a lever, journal means for pivotably mounting said lever intermediate its extremities on said body portion, said lever having a latch on one side of said journal means for engaging said bill, said control means including means acting on the lever on the other side of said journal means.

3. In a tufting machine as recited in claim 1 wherein said blade has a loop engaging edge, said loop engaging edge being that part of the blade against which loops permitted entry onto said hook are severed, said loop engaging edge being disposed closer to the base fabric than the loops formed by the needle, said means for feeding yarn to said needle feed a predetermined length of yarn as required to form a loop disposed at said opposite side of the base fabric at the level of said loop engaging edge, whereby each loop will be backdrawn to the level of said loop engaging edge.

4. In a tufting machine as recited in claim 3 wherein said gate means comprises a lever, journal means for pivotally mounted said lever intermediate its extremities on said body portion, said lever having a latch on one side of said journal means for engaging said bill, said control means including means acting on the lever on the other side of said journal means.

5. In a tufting machine as recited in claim 1 wherein said gate means comprises a shuttle, means for slideably mounting said shuttle for movement toward and away from said bill, said shuttle having a latch on one end for engaging said bill, said control means including means acting on another end of said shuttle for selectively sliding the shuttle into and out of closing engagement with said bill.

6. In a tufting machine as recited in claim 3 wherein said gate means comprises a shuttle, means for slideably mounting said shuttle for movement toward and away from said bill, said shuttle having a latch on one end for engaging said bill, said control means including means acting on another end of said shuttle for selectively sliding the shuttle into and out of closing engagement with said bill.

7. In a tufting machine as recited in claim 1 wherein said gate means comprises a shuttle having a latch, and mounting means for mounting said shuttle for oscillation with said hook and for sliding relatively to the hook to selectively engage said latch with said bill.

8. In a tufting machine as recited in claim 7 wherein said mounting means includes a slideably mounted block actuated by said control means and movable between open and closed positions, said block and shuttle having cooperable means for slideably positioning said latch and for allowing oscillatory movement of the shuttle when the block is in the open and in the closed positions.

9. In a tufting machine as recited in claim 8 wherein said cooperable means comprises a tang formed on said shuttle remote from said latch, and means defining an opening having a pair of opposed walls formed in said block for receiving said tang, said walls spaced being apart a distance substantially equal to the distance between the oscillation limits of the hook.

10. In a tufting machine, means for supporting a base fabric, means for stitching a yarn continuously through said base fabric to form loops therein, a hook having a free end for entering the loops in succession, and a closed end, said hook having a bill at the free end and a blade intermediate said bill and said closed end, means for relatively moving said loops upon said hook toward said closed end, means cooperating with said blade for severing loops thereon, gate means for engagably cooperating with the bill for closing the passage of a loop onto the hook and for seizing said loop and for disengaging from said bill for opening the passage of a loop onto the hook, and control means for selectively moving said gate means into and out of engagable cooperation with said bill, whereby loops passing onto the hook are severed and loops prevented from passing onto the hook remain uncut.

11. In a tufting manchine as recited in claim 10 in which means are provided for feeding said fabric in the direction of the closed end of said hook.

12. In a tufting machine as recited in claim 10 wherein said gate means comprises a lever having a latch portion, and means for pivotably mounting said lever on said hook for movement of said latch portion toward and away from said bill.

13. In a tufting machine as recited in claim 10 wherein said blade has a loop engaging edge, said loop engaging edge being that part of the blade disposed furthest from the base fabric and against which loops permitted entry onto said hook are severed, said loop engaging edge being disposed closer to said base fabric than the loops formed by the stitching means, means for feeding a predetermined length of yarn to said stitching means to form each loop, said length of yarn being such as to form a loop disposed at the level of the loop engaging edge of said blade, whereby each loop will be backdrawn to the level of said loop engaging edge.

14. In a tufting machine as recited in claim 13 wherein said severing means comprises a knife, and means for oscillating said knife to cooperate with said loop engaging edge of said blade.

15. In a tufting machine as recited in claim 10 wherein said gate means comprises a shuttle having a latch portion, and means for slideably mounting said shuttle for movement of said latch portion toward and away from said bill.

16. In a tufting machine, means for feeding a base fabric in one direction, a yarn-carrying needle disposed on one side of the base fabric, means for reciprocating said needle for penetrating said fabric and forming loops therein, a hook disposed on the other side of the base fabric from the needle and having a free end facing in a direction opposite to the direction of feed of the fabric for entering the loops in succession, and a closed end, said hook having a bill at the free end, a blade intermediate said bill and said closed end and including a loop engaging edge, means for oscillating said hook toward and away from said needle, a knife for cooperating with the blade of said hook to sever loops on said loop engaging edge, means for oscillating said knife, a gate oscillating with the hook and movable relative to said bill, said gate having a free end for selectively engaging and disengaging said bill to respectively close and open passage of a loop onto said hook, control means for moving said gate into and out of engagement with the bill so that certain loops are seized by the hook and move onto the blade and other loops are seized and then shed by the gate, and means for feeding to said needle upon each penetration a length of yarn inadequate to accommodate the yarn requirments of the system, whereby all the loops will be backdrawn to the level of the loop engaging edge.

17. In a tufting machine as recited in claim 16 wherein said gate is pivotally mounted on said hook.

18. In a tufting machine as recited in claim 16 wherein said gate is slideably mounted relatively to said hook.

19. In a tufting machine as recited in claim 16 wherein said means for oscillating said hook includes a hook support bar for carrying said hooks, said gate comprising a slideable shuttle, and means for slideably mounting said shuttle in said hook support bar.

20. A method of tufting cut pile and loop pile in the same row of stitching comprising supporting and feeding a base fabric in one direction, stitching a yarn continuously through said base fabric as the fabric moves to form a row of successive yarn loops on one side of said fabric, supporting upon said one side of said fabric an oscillating hook having a free end pointing in the direction opposite the fabric feed so that the free end enters the loops in succession and having a blade portion adjacent the free end, severing a selected loop upon the blade portion to produce cut pile, closing the free end with a movable gate to prevent seizure of another selected loop by said hock, seizing said other selected loop by said gate, and thereafter shedding said other selected loop from the gate to produce an uncut loop.

21. A method of tufting cut pile and loop pile in the same row of stitching comprising supporting and feeding a base fabric in one direction, stitching a yarn continuously through said base fabric as the fabric moves to form a row of successive yarn loops on one side of said fabric, supporting upon said one side of said fabric an oscillating hook having a free end pointing in the direction opposite the fabric feed so that the free end enters the loops in succession and having a blade portion adjacent the free end, closing the free end with a movable gate to prevent seizure of a selected loop by said hook, seizing and thereafter shedding said selected loop by the gate to produce an uncut loop, moving the gate away from the free end to permit entry of another selected loop onto said hook, and severing said other selected loop upon the blade portion to produce cut pile.

22. A method of tufting cut pile and loop pile in the same row of stitching comprising supporting and feeding a base fabric in one direction, actuating a needle to stitch a yarn continuosly through said base fabric as said fabric moves to form a row of successive yarn loops on one side of said fabric, supporting upon said one side of said fabric an oscillating hook having a free end pointing in the direction opposite to the direction of fabric feed so that the free end enters the loops in succession and having a blade portion adjacent the free end and disposed closer to said base fabric than said free end, feeding to said needle upon each stitch a predetermined length of yarn that is inadequate to accomodate the yarn requirements of the system, closing the free end with a movable gate to prevent entry of a selected loop onto said hook, seizing said selected loop by the gate and thereafter shedding said selected loop from the gate to produce an uncut loop, moving the gate away from the free end to permit entry of another selected loop onto said hook, backdrawing yarn from each loop intermediate the formation of each loop and the next successive loop to reduce the size of each loop to substantially the level of the blade portion, and severing said other selected loop upon said blade portion to produce cut pile.

* * * * *